US006430381B1

(12) United States Patent
Kopp

(10) Patent No.: US 6,430,381 B1
(45) **Date of Patent: *Aug. 6, 2002**

(54) THERMAL FIXING SYSTEM FOR RECORDING MEDIA OF A PRINTER OR COPIER DEVICE THAT ARE PRINTED ON ONE OR BOTH SIDES

(75) Inventor: Walter Kopp, Taufkirchen (DE)

(73) Assignee: Océ Printing Systems AG, Poing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 08/942,954

(22) Filed: Oct. 2, 1997

Related U.S. Application Data

(60) Continuation of application No. 08/579,970, filed on Dec. 28, 1995, now Pat. No. 5,758,227, which is a division of application No. 08/194,526, filed on Feb. 10, 1994, now Pat. No. 5,495,324.

(30) Foreign Application Priority Data

Jul. 28, 1993 (EP) ..... 93112069

(51) Int. Cl.[7] ..... G03G 15/20

(52) U.S. Cl. ..... 399/69; 399/328; 399/384

(58) Field of Search ..... 399/45, 69, 328, 399/384, 330, 331, 334; 219/216, 464, 388

(56) References Cited

U.S. PATENT DOCUMENTS

| | | | |
|---|---|---|---|
| 3,517,164 | A | 6/1970 | Huggins et al. |
| 3,752,612 | A | 8/1973 | Van Duuren |
| 3,861,863 | A | 1/1975 | Kudsi |

(List continued on next page.)

FOREIGN PATENT DOCUMENTS

| | | |
|---|---|---|
| DE | 27 17260 C3 | 7/1986 |

OTHER PUBLICATIONS

Japanese Abstract 57–124774.
Japanese Abstract 60–14777.
Japanese Abstract 61–35472.
Japanese Abstract JP63292177.
Japanese Abstract 58–120284.
Japanese Abstract 61–255372.
Relationships Between oner Properties, Fuser Parameters, and Fixing of Electrophotographic Images, R. Bruce Prime, pp. 19–25.

*Primary Examiner*—Robert Beatty
(74) *Attorney, Agent, or Firm*—Schiff Hardin & Waite

(57) ABSTRACT

In a thermal fixing system for fixing toner images on the front side of a recording medium in an electrographic printer or copier device, the back side of the recording medium can already have a fixed toner image. The thermal fixing means contains a heat transfer fixing station that fixes the toner images on the recording medium, and contains a pre-heating saddle that precedes the heat transfer fixing station in a running direction of the recording medium. A sliding surface that accepts the recording medium over its back side is allocated to the pre-heating saddle. The sliding surface is constructed of a toner-repellant material at least in a contact region with the recording medium. The preheating saddle is designed as a low temperature saddle with the largest possible constructional length, so that a temperature difference between recording substrate and saddle surface is as small as possible. The preheating saddle has, in the recording substrate running direction, a plurality of heating zones. A control device controls the heating zones in such a manner that, along the preheating saddle, an approximately constant thermal energy flow occurs on the saddle surface to the recording substrate. For matching the preheating saddle to various recording substrate widths, the preheating saddle is subdivided, transversely to the recording substrate running direction, into individually drivable transverse heating zones.

16 Claims, 7 Drawing Sheets

U.S. PATENT DOCUMENTS

| | | | | | |
|---|---|---|---|---|---|
| 4,147,922 | A | | 4/1979 | Naeser | |
| 4,217,093 | A | | 8/1980 | Steinlehner et al. | |
| 4,513,898 | A | | 4/1985 | Spitsbergen | |
| 4,561,792 | A | | 12/1985 | Behrens et al. | |
| 4,835,573 | A | | 5/1989 | Roher et al. | |
| 5,151,743 | A | | 9/1992 | Yaguchi | |
| 5,179,417 | A | | 1/1993 | Sugaya et al. | |
| 5,323,944 | A | | 6/1994 | Faust et al. | |
| 5,495,324 | A | * | 2/1996 | Kopp | 399/328 |
| 5,568,241 | A | * | 10/1996 | Creutzmann et al. | |
| 5,758,227 | A | * | 5/1998 | Kopp | 399/69 |

* cited by examiner

THERMAL FIXING SYSTEM FOR RECORDING MEDIA OF A PRINTER OR COPIER DEVICE THAT ARE PRINTED ON ONE OR BOTH SIDES

This is a continuation, of application Ser. No. 08/579,970 filed Dec. 28, 1995, now U.S. Pat. No. 5,758,227 which is a division of Ser. No. 08/194,526 filed Feb. 10, 1994 now U.S. Pat. No. 5,495,324.

BACKGROUND OF THE INVENTION

The invention is directed to a thermal fixing system for fixing toner images on the front side of a web-shaped recording medium in an electrographic printer or copier device, whereby the back side of the recording medium can already have a fixed toner image.

Thermal fixing devices that comprise a pre-heating saddle with a following fixing zone composed of a heated fixing drum and a pressure roller are employed in printer or copier devices for heat transfer fixing of toner images on a recording medium that is usually composed of paper.

Such thermal fixing devices are disclosed, for example, by U.S. Pat. No. 4,147,922 or Japan Abstract Vol. 13, No. 120, Mar. 24, 1989 (Japan-A-63-292177).

It is beneficial in electrographic printer devices that work in the highest speed range with, for example, a printing speed of more than 0.5 m/s, and that employ a heat transfer fixing station for fixing, to heat the paper web or the paper sheet to temperatures of approximately 100° C. or more before the actual heat transfer fixing process in order to thus obtain a good joining of the toner image to the paper surface.

When a paper web or a single sheet of paper that is already printed and fixed on one side, for example on the back side, is to be printed and fixed on the other side, then the first side which is already fixed must be conducted over the hot surface of the pre-heating saddle for heating the paper for the second fixing process. The following problems thereby arise in this second fixing process:

a) Continuous printer operation:

The print image that is already fixed and that runs over the hot surface of the pre-heating saddle is heated to such an extent that it assumes a condition ranging from tacky through fluid, and is partly smeared on the saddle surface. The more toner is transferred from the toner image onto the saddle surface the more toner collects on the saddle surface, until a visible destruction of the toner image on the paper occurs.

b) Waiting or Standby Operation:

While the printer is in the waiting or standby mode, the paper web having the already fixed print image lies on the hot saddle. The print image is heated to such an extent in the region of the surface of the pre-heating saddle that it assumes a tacky through fluid condition and sticks to the hot surface of the pre-heating saddle. When the paper web is started, the toner image is then torn from the surface of the paper web and remains sticking on the hot surface of the saddle.

In the case of the known fixing devices, there is another problem. It has previously been assumed that it is necessary to preheat the paper very rapidly over a relatively short path, via the preheating saddle, and then to fix the toner image on the paper via the rollers. For this purpose, the heating elements are arranged in the preheating saddle in such a way that the greatest quantity of heat is emitted to the recording substrate in the region of the paper inlet of the preheating saddle and that the emitted quantity of heat is then reduced over the heating elements in the direction of the paper exit. Thus, the relatively hottest region of the saddle is the paper inlet.

However, it has appeared that a rapid heating up of the paper over a short path leads to a high loading of the paper. This loading is expressed as a deformation, an embrittlement or an ageing of the paper and as a non-uniform loss of water from the paper during passage through the fixing station. Hence, post-processing of the paper by cutting or sorting is made more difficult or there occurs a non-uniform fixing of the toner images and thus an impairment of the quality of the print.

In addition, a rapid heating up requires a high specific heating power using high-power heating elements and a complicated control system. Because of the high heating power it is therefore necessary to lift the recording substrate immediately from the saddle in the event of a printer stop, in order to prevent buning of the paper. His makes comprehensive control devices necessary, which impairs the paper handling as a whole.

In modem electrophotograhic printing devices, furthermore, recording substrates of the most different widths are processed in the same machine. If the same amount of energy is fed to the saddle over the entire width, the saddle heats up severely in that region where there is no paper running, since in this region no energy is dissipated, apart from losses due to convection.

A temperature distribution of this type has considerable disadvantages. The paper is heated up non-uniformly, which leads to fluctuations in the fixing quality and can also cause paper running problems. The maximum heating saddle temperature must be reduced, since there exists the risk of overheating of the heating elements and the lifetime of the heating elements is thereby shortened. The energy losses are relatively large and the inner region of the machine is heated up unnecessarily.

In the case of thermofixing devices with a preheating saddle, the recording substrate is guided over a heated gliding surface of the saddle. Direct contact between paper and saddle is essential for a good thermal transfer between paper and saddle surface. In the case of high printing speeds and in the use of pre-folded papers or papers of non-uniform thickness, fluttering movements of the paper can occur in the region of the saddle. In consequence, the paper lifts partially off from the saddle, which impairs the thermal transfer. Also, paper contains a relatively high proportion of water, which is released during warming. The released steam can be deposited in the machine and can lead there to disturbances or to corrosion.

SUMMARY OF THE INVENTION

It is an object of the invention to provide a thermal fixing means having a pre-heating saddle for fixing toner images on the front side of a recording medium in an electrographic printer or copier device, whereby the back side of the recording medium can already have a fixed toner image.

It is another object of the invention to provide a thermofixing device and a process for fixing, in which the recording substrate is exposed to as small a thermal loading as possible during passage through the fixing device.

It is a further object of the invention to provide a thermofixing device which makes it possible, without fluctuations of the fixing quality, to fix recording substrates of the most different widths and in which warping and deformations of the fixed recording substrate are avoided.

According to the invention, a thermal fixing system is provided for fixing toner images on a front side of a recording medium in an electrographic printer or copier device wherein a back side of the recording medium already has a fixed toner image. A heat transfer fixing station is provided for fixing the toner images on the recording medium. A pre-heating saddle precedes the heat transfer fixing station and a running direction of the recording medium has a sliding surface allocated thereto for accepting the recording medium over its back side. The sliding surface comprises a toner-repellant material at least in a contact region of the recording medium.

The specification of front side and back side of a recording medium is a purely relative matter for describing the two sides of a recording medium.

When the recording medium, which can be composed of single sheets or of continuous form paper, is conducted over a pre-heating saddle having a sliding surface that exhibits a repellant property for the tacky through fluid toner and has high abrasion resistance with respect to the paper web sliding thereon, then the thermal fixing means can be employed in printer or copier devices that work both in a simplex as well as in a duplex mode.

Materials that are manufactured of fluorine compounds such as, for example, PTFE or, respectively, PFA compounds, have proven beneficial. The material can be vapor-deposited, sprayed, or glued on an appropriate acceptance surface of a pre-heating saddle. PTFE or, respectively, PFA compounds exhibit extremely good repellency with respect to the toner material and exhibit extremely good properties regarding abrasion, due to the paper web.

In order to enhance the abrasion resistance, wear-reducing constituents such as graphite or glass fibers can be mixed to the PTFE or PFA to a more or less pronounced degree.

Since such pre-heating saddles are usually utilized in electrographic printer devices of the higher performance category (between 2 and 10 million DIN A4 pages per month), non-wearing operation over years is impossible. For this reason, it is meaningful when the saddle surface can be unproblematically and simply renewed as needed, without the expensive base structure of the heating saddle with heating elements having to be renewed. For this purpose, a toner-repellant layer can be vapor-deposited, sprayed, or glued onto thin metal plates, whereby these coated, individual plates are then interchangeably secured on the base structure of the pre-heating saddle.

In an advantageous embodiment of the invention, the toner-repellant layer is executed as a film which has a thin, thermally conductive adhesive layer on one side. The adhesive layer is implemented such that the film can be easily pulled from the saddle in the hot condition of the saddle. A fast renewal of the saddle surface is thus rapidly possible, as needed on site by the customer.

The toner-repellant layer can also be implemented as a thin film that is taken from a supply reel, is guided over the surface of the pre-heating saddle and is then again wound up. The film is thus moved extremely slowly relative to the running direction of the paper.

In order to obtain a fold-free entry of the paper web into the fixing gap between fixing drum and pressure drum, it has already been proposed to design that end of the pre-heating saddle facing toward the fixing gap as a smoothing edge over which the recording medium is deflected to a great degree. However, extremely high wear of the toner coating on the recording medium occurs in the wrap region in the region of the smoothing edge. This wear can be prevented when rollers that may potentially be provided with a toner-repellant coating are provided in the wrap region.

When a relatively high proportion of graphite or glass fibers is added to the toner-repellant material in order to achieve high wear resistance of the surface, then the repellency of the surface relative to the toner image may potentially be reduced. In order to prevent a transfer of the toner image onto the saddle surface in such cases during a long waiting or standby mode of the printer devices, it is beneficial to lift the recording medium off from the saddle surface. This can occur wherein an air pillow is produced between the paper web and the saddle surface or sliding surface with the assistance of a blower means in the standby condition of the printer device. Another possibility for lift-off is comprised in providing a suitable lift-up element designed, for example, as a tension wire that engages under the recording medium over its entire width. The pre-heating saddle and lift-off element are thereby moved relative to one another such that, in a lift-off status, the recording medium is guided over the lift-off element at a distance from the pre-heating saddle.

As a rule, the paper web is automatically placed into the printer in electrographic continuous form printers of the new generation. Among other things, the paper web must thereby be guided over the pre-heating saddle. Coatings composed of fluorine compounds electrostatically charge at their surface when paper slides thereon. Due to the electrostatic forces, the paper web adheres so firmly to the pre-heating saddle that it may potentially no longer be capable of being transported. An advantageous admixture of electrostatically conductive substances such as graphite or the like can prevent the formation of electrostatic charges. It is beneficial, given glued layers of material, when the adhesive is likewise conductive in order to thus produce a conductive connection between toner-repellant material and grounded carrier.

Also, according to the invention, if the saddle is configured as a low temperature saddle with as large a constructional length as possible, so that the temperature difference between recording substrate and saddle becomes as small as possible, and if, furthermore, the saddle is subdivided in the recording substrate running direction into heating zones which are individually controllable and uniformly heated, the heating zones can then be controlled in such a way that, along the saddle, an approximately constant thermal energy flow occurs from the saddle to the recording substrate.

By means of this measure, the thermal loading for the recording substrate becomes very low. Nevertheless, the thermofixing device can also be used in printing devices of high and very high printing speed.

Furthermore, the subdivision of the saddle, transversely to the recording substrate running direction, into heating zones which can be driven as a function of the width of the recording substrate is of advantage.

In consequence, the heating behavior of the saddle can be matched directly to the width of the recording substrate running through, which guarantees a constant fixing quality, irrespective of the width of the recording substrate used.

In order to make possible a good contact between recording substrate and gliding surface of the saddle, irrespective of printing speed and paper used, in an advantageous embodiment of the invention openings can be arranged on the gliding surface, said openings being connected to a device producing a vacuum. By means of the vacuum, the recording substrate is sucked flat onto the gliding surface and, in the process, the steam released in the paper is simultaneously sucked away via the openings.

Furthermore, if use is made for heating elements of heating cartridges which are arranged in passage openings of the heating saddle, said heating cartridges can easily be exchanged and the saddle itself can be cost-effectively produced from an extruded profile.

A domed shaping of the gliding surface of the saddle ensures a force component, which pressed the recording substrate against the saddle surface, over the entire saddle length. This measure supports the contact of the recording substrate on the saddle surface, stabilizes the recording substrate guidance and thus leads to an improved thermal transfer.

In a further advantageous embodiment of the thermofixing device, peripheral entry means, for example in the form of a keyboard, are provided on the machine, via which means, by means of the entry of operating parameters such as paper weight, fixing temperature, etc., the heating power of the fixing device is automatically matched to these parameters.

Embodiments of the invention are shown in the drawings and shall be set forth in greater detail below by way of example.

DESCRIPTION OF THE PREFERRED EMBODIMENTS

Figures 1, 2:
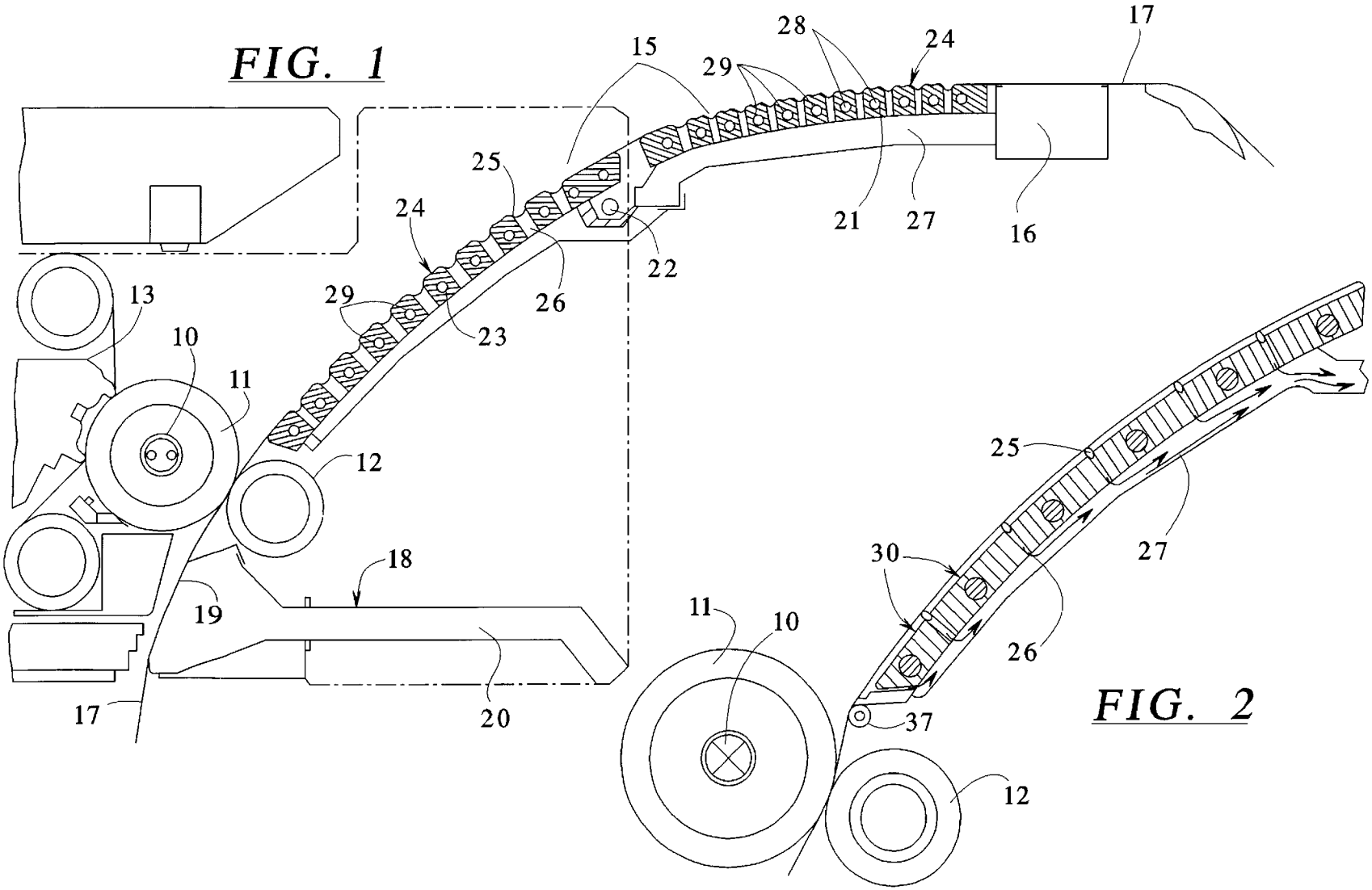
FIG. 1 is a schematic sectional view of a thermal fixing system for an electrographic printer device.
FIG. 2 a schematic sectional view of a pre-heating saddle with a sliding surface composed of toner-repellant material.

An electrographic printer device for printing continuous form papers contains a thermal fixing means schematically shown in FIG. 1. The thermal fixing system is designed as a heat transfer fixing means. It contains a heating drum 11 heated via radiators 10 and contains a pressure roller 12 that can be electromotively pivoted against and away from the heating drum 11. The heating drum is composed of an aluminum cylinder having a heat-resistant coating arranged thereon. The pressure roller is likewise composed of an aluminum cylinder having a coating of silicone. The heating drum 11 is electromotively driven. The heating drum 11 has an oiling means 13 allocated to it for applying mold lubricant onto the heating drum. A heated pre-heating saddle 15 with negative pressure brake 16 associated therewith precedes the rollers as viewed in the conveying direction of the recording medium. This pre-heating saddle 15 serves the purpose of pre-heating a recording medium 17 designed as a continuous form paper and supplies it to the actual fixing gap between the rollers 11 and 12 in its pre-heated condition. The recording medium 17 is conducted over the pre-heating saddle 15 in taut fashion because it is decelerated by the negative pressure brake 16 and is driven via the rollers. A loose toner image on the recording medium is pre-heated on the pre-heating saddle 15 and is fixed between the rollers 11 and 12 by heat and pressure.

A cooling device 18 following the rollers 11 and 12 in the paper running direction provides for a cooling of the entire paper. For this purpose, the cooling device 18 contains a cooling surface 19 provided with apertures across which the recording medium 17 moves. Cold air supplied via an air delivery channel 20 flows from the apertures and produces a cooling air cushion under the recording medium 17. At the same time, air is blown onto the tonered side of the recording medium via a profile lying opposite thereto.

Given the described thermal fixing means, the pre-heating of the continuous form paper 17 occurs via a low-temperature pre-heating saddle 15 that is composed of two heated saddles connected following one another, namely of a stationary pre-heating saddle 21 and of a heating saddle 23 pivotable around a pivot point 22. Pre-heating saddle 21 providing a first heating zone of lower temperature and heating saddle 23 providing a second heating zone of higher temperature to thus form two separate heating zones as viewed in the paper running direction. The entire pre-heating path thereby has a length of approximately 500 through 700 mm. During the pre-heating, the paper 17 slides on sliding surfaces 24 of the pre-heating saddle 21 or heating saddle 23.

In order to produce a good contact between the saddles and the paper and to thus keep the temperature difference small, the sliding surface or the saddles are designed arcuately and with an arc radius that amounts to 700 mm in the illustrated example. Due to the arc of the sliding surfaces in combination with the traction by the rollers 11 and 12 and the deceleration by the negative pressure brake 16, a force component acts over the entire saddle length that presses the paper 17 against the sliding surfaces 24. Moreover, the stability of the paper running on the saddle is thereby enhanced. The saddles 21 and 23 comprise oblong depressions 25 transversely relative to the paper running direction which extend over the entire width of the saddles. They are connected to a channel 27 by lateral bores 26. The air channel proceeds under the saddles and is connected to a pneumatic means that produces an over-pressure and under-pressure, for example to a blower and to a pump. During the printing mode, the recording medium (paper) is suctioned against the sliding surfaces 24 of the saddles by under-pressure, and the water vapor being released due to the pre-heating is suctioned off. During standby mode, an air pillow is produced between the recording medium 17 and saddles or sliding surface 24 due to over-pressure.

The heating of the saddles 21 and 23 occurs with electrical resistance elements in the form of interchangeably arranged heating cartridges that are arranged in bores 29. The pre-heating saddle is designed as a low-temperature saddle whose heating capacity is controlled via a microprocessor-controlled regulator arrangement.

Figure 3:
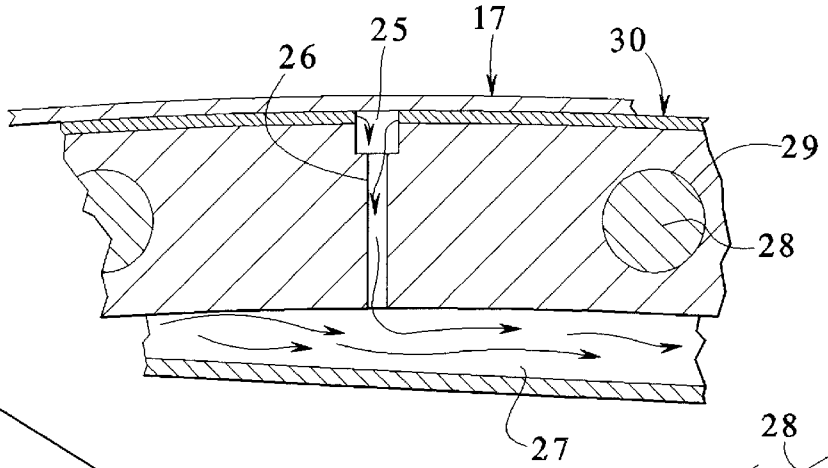
FIG. 3 is a schematic sectional view of a portion of FIG. 2.
Figure 15A:
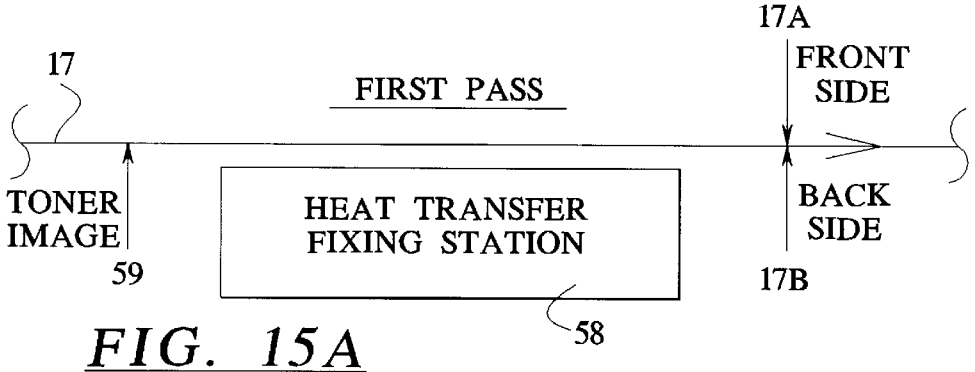
FIG. 15A shows in the first pass a fixing of a toner image on a backside of the recording medium.
Figure 15B:
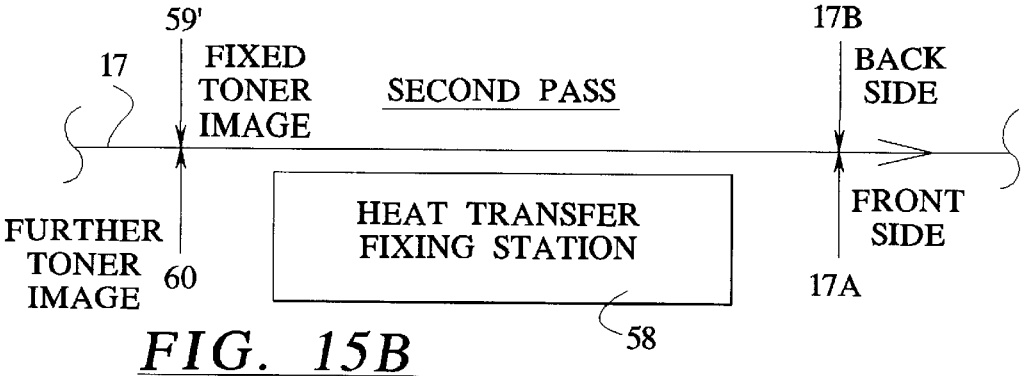
FIG. 15B shows in a second pass fixing of a further toner image on a front side of the recording medium.

As shown in FIGS. 15A and 15B the thermal fixing means or station 58 is also suitable for fixing recording medium 17 that already have a fixed toner image 59' on their back side 17B. This toner image 59 can be printed and fixed on the back side 17B (or on the front side) of the recording medium 17 in a first pass as shown in FIG. 15A. After this, a further toner image 60 is applied and fixed on the corresponding other side 17A in a further or second pass as shown in FIG. 15B. For this purpose, the sliding surface 24 according to the illustration of FIGS. 2 and 3 is composed of a toner-repellant plastic layer, of a fluorine compound, for example a PTFE or, respectively, a PFA compound, that is vapor-deposited, sprayed, or glued onto the worked surface of the pre-heating saddle 15. The compounds are described as follows:

Polytetrafluorethylene (PTFE) having the structural formula:

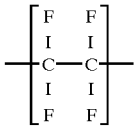

Perfluoroalkoxy polymers (PFA) having the structural formula:

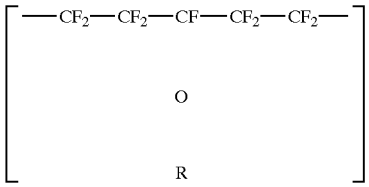

with $R=C_nF_{n+1}$ as a perfluoridated alkane side chain.

PTFE or PFA compounds exhibit extremely good repellency with respect to the toner material and extremely good properties with respect to abrasion due to the paper web. In order to enhance the abrasion resistance, constituents such as graphite or glass fibers can be added to a greater or lesser extent to the toner-repellant layer.

Since heating saddles are usually employed in electrographic printer devices of the upper performance category having a page capacity of 2 through 10 million DIN A4 pages per month, these heating saddles are subject to relatively high wear. For this reason, it is beneficial when the saddle surface can be unproblematically and simply renewed as needed without the expensive basic structure of the heating saddle with heating element having to be replaced as well.

Figure 4:
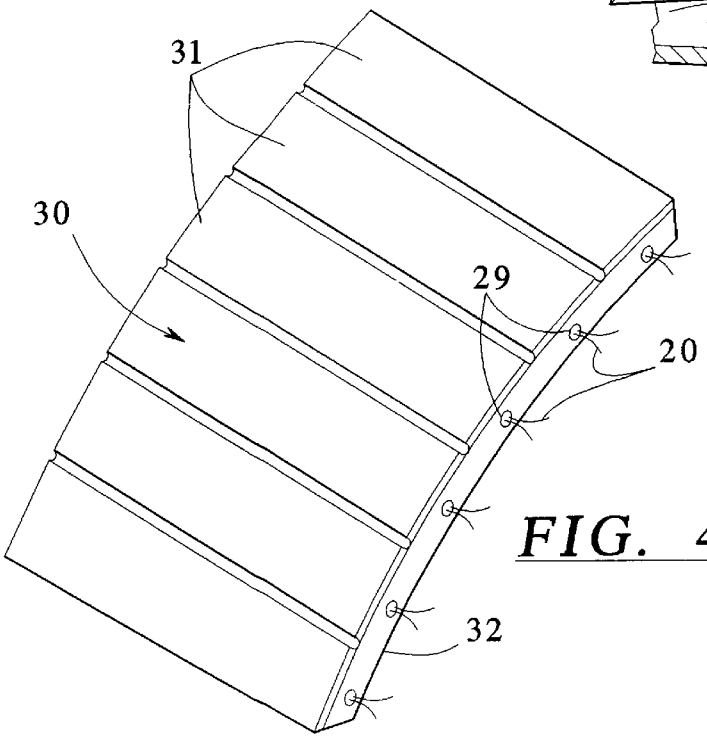
FIG. 4 is a schematic illustration of a pre-heating saddle having coated metal plates arranged thereon as a sliding surface.

In order to enable this replaceability, the toner-repellant layer 30 in an exemplary embodiment according to FIG. 4 is vapor-deposited, sprayed, or glued onto thin metal plates 31. The thin metal plates 31 can have a thickness of 1 through 5 mm and are interchangeably clamped or screwed on the basic structure 32 of the pre-heating saddle.

The toner-repellant layer 30 can also be executed as a thin film which has a thin, highly thermally conductive adhesive layer on one side. The adhesive layer is implemented such that the film can be easily pulled from the saddle in the hot condition of the saddle. A fast renewal of the saddle surface is thus very rapidly possible as needed on site at the customer.

Figure 5:
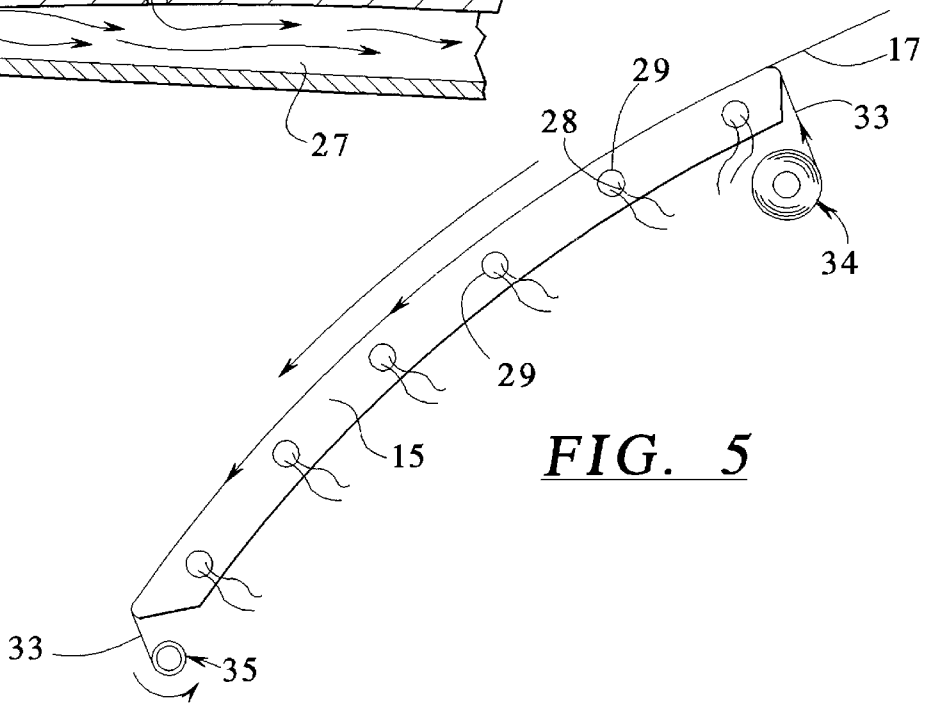
FIG. 5 is a schematic illustration of a pre-heating saddle with a corresponding film conveying means.

In an exemplary embodiment shown in FIG. 5, the toner-repellant layer 30 is designed as a thin film 33. The film 33 extends over the entire width of the pre-heating saddle. It is wound on a reel 34 as a reserve supply, this reel 34 being attached under the pre-heating saddle in the saddle entry region. This film, proceeding from this supply reel 34, is stretched over the pre-heating saddle up to the outlet of the heating saddle in the paper ruming direction and is in turn wound up on a take-up reel 35 under the pre-heating saddle. With the assistance of a drive means coupled to the take-up reel 35, the film is moved extremely slowly in relationship to the speed of the recording medium and is wound onto the take-up reel 35. A film supply is located on the supply reel 34 of the admission side; this can be designed for the entire service life of the printer. The pre-heating saddle is designed maintenance-free in this way.

Figure 6:
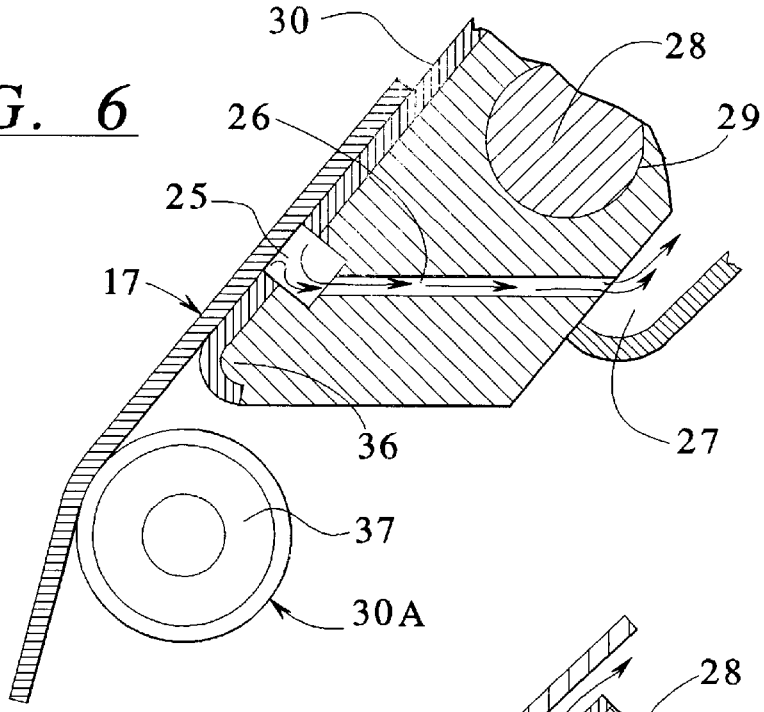
FIG. 6 is a schematic sectional view of a pre-heating saddle with an allocated smoothing roller.

In order to obtain a fold-free entry of the recording medium web 17 into the fixing gap between fixing drum 11 and pressure roller 12, it is beneficial to guide the paper web around the paper discharge saddle edge 36 of the pre-heating saddle in a wrap. However, extreme wear of the toner image already fixed on the recording medium occurs in this wrap region. According to an embodiment shown in FIG. 6, this wear can be prevented in that one or more deflection rollers 37 in the form of smoothing rollers are arranged in the wrap region, these likewise being potentially provided with a toner-repellant coating 30A. The smoothing rollers 37 steer the recording medium 17 out of a running direction defined by the sliding surface 24 into an admission direction to the heat transfer fixing station, namely with a deflection angle that is dimensioned such that a smoothing effect is exerted on the recording medium 17.

When a relatively high proportion of graphite or glass fibers is added to the toner-repellant layer 30 for achieving a high resistance to wear of the surface, then the repellency of the surface to toner can be potentially reduced. In order to prevent a transfer of the toner image onto the pre-heating saddle surface in such instances during a long waiting or standby status of the printer device, it is beneficial to lift the recording medium 17 off from the surface of the pre-heating saddle in the standby condition of the printer device.

Figure 7:
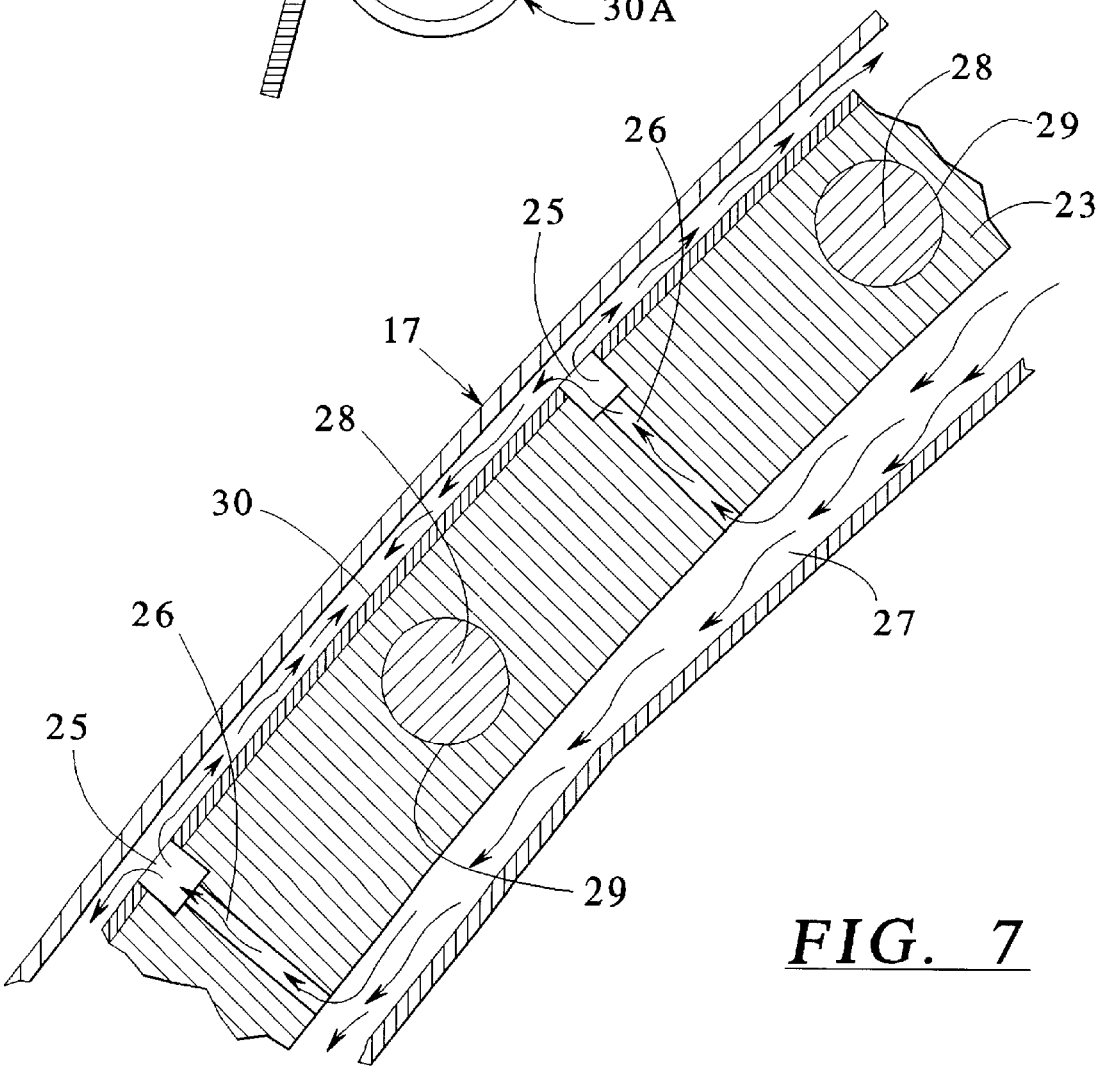
FIG. 7 is a schematic sectional view of a portion of a pre-heating saddle having a pneumatic means for producing an air pillow between the recording medium and the pre-heating saddle as needed.

In the exemplary embodiment of FIG. 7, air is supplied to the bores 26 and to the slots 25 via the pneumatic channel 27 during the standby status for this purpose, so that an air pillow that holds the recording medium 17 at a distance from the sliding surface 24 arises between sliding surface 24 and recording medium 17. Sticking of the recording medium to the surface of the pre-heating saddle is thus precluded. When a film 33 as shown in FIG. 5 is employed as a toner-repellant layer, then an air cushion can be similarly produced between film 33 and the pre-heating saddle.

Figure 8:
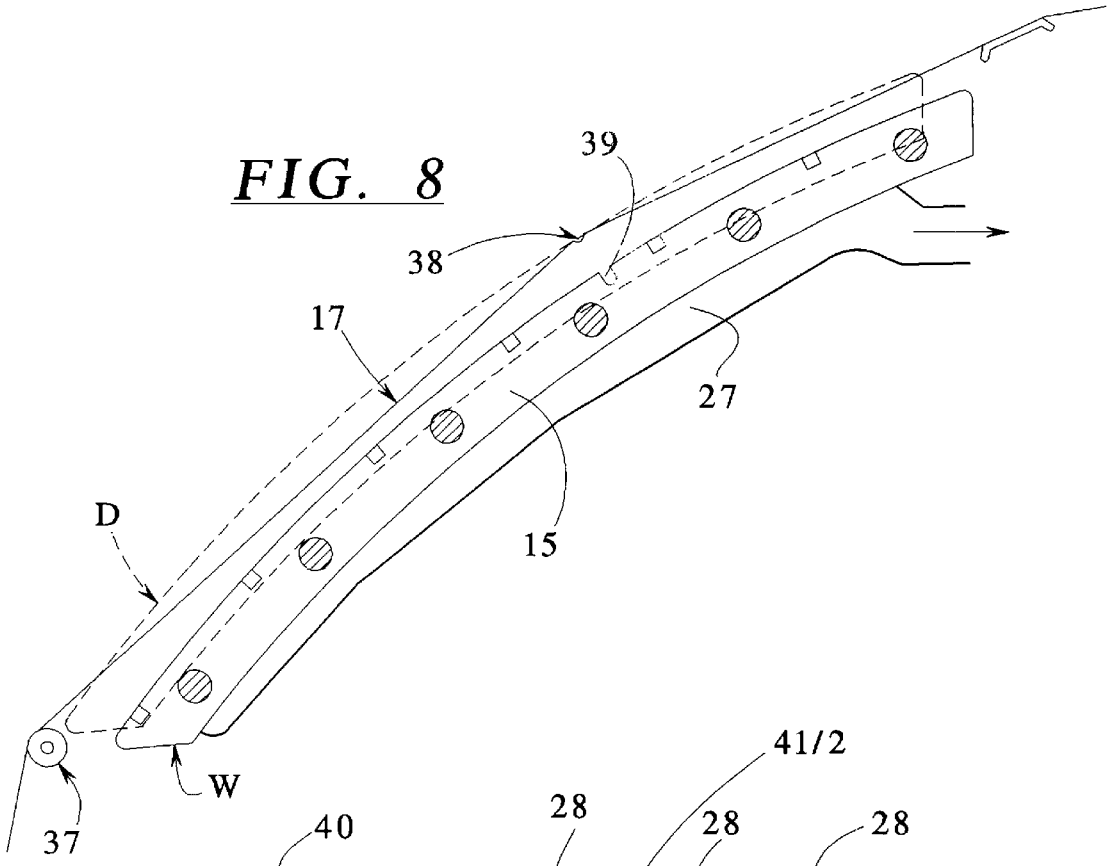
FIG. 8 is a schematic sectional view of a pre-heating saddle having a corresponding mechanical lift-off device for the recording medium.

Another possibility for lifting the recording medium off from the pre-heating saddle in the standby mode of the printer device is shown in FIG. 8. A lift-off element, for example in the form of a tension wire 38, that engages under the recording medium 17 in the region of the pre-heating saddle, is stationarily arranged in mounts of the printer device, such that the tension wire 38 comes to lie in a recess 39 of the pre-heating saddle in a position D of the pre-heating saddle allocated to the printing mode. When the pre-heating saddle or the heating saddle is pivoted out of the printing position D into a waiting position W, the tension wire 38 remains stationary and the paper web 17 is thereby lifted off from the hot surface of the pre-heating saddle.

Another possibility is a pivoting of the tension wire 38 or other paper deposit elements out of the surface of the pre-heating saddle and lowering them in turn into the surface when the printing mode is initiated.

In electrographic printer devices of the newer generation, the recording medium 17 is automatically inserted into the printer device. Among other things, the paper web must thereby be conducted over the pre-heating saddle. Coatings of fluorine compounds such as PTFE or PFA electrostatically charge to an extreme degree on their surface when paper slides thereon. It can thus occur that the electrostatic forces produced in this way impede further conveying of the paper web 17. Such electrostatic charges can be prevented by mixing electrostatically conductive substances, for example graphite or similar materials, into the toner-repellant layer 30. When the toner-repellant layer 30 is composed of a layer glued onto the pre-heating saddle, it is necessary to likewise design the adhesive to be conductive in order to thus produce a conductive connection to the pre-heating saddle, which is beneficially grounded.

Controlled Heating

In the case of the thermofixing of a recording substrate with a toner image arranged thereupon, in a fixing gap, under pressure and heat, the toner image comprising polymeric material, for example polyester, is heated via a heated fixing roller until in the melting range and is thus bonded with the recording substrate.

In this arrangement, the recording substrate is pressed against the fixing roller via one or more nip rollers. The boundary surface between the toner particles and the surface of the recording substrate is decisive for the fixing. In this region, the melting temperature of the toner must be reached carefully and without excessive heating, so that the toner ends with the recording-substrate or sticks-to the latter. If, during fixing in the fixing zone (fixing gap), the recording substrate has an essentially lower temperature than the toner, heat is withdrawn from the boundary surface via the recording substrate, which can lead to faulty fixing. For this reason, the recording substrate with the toner image arranged thereon is preheated before feeding into the fixing gap. In this case, it is favorable if the recording substrate is preheated to a temperature which already lies in the melting range of the toner material. In this range, which lies between 90°–125° in the case of a polymeric toner, the toner is already slightly sticky at the boundary surface with the recording substrate, which facilitates the actual fixing in the fixing gap. In the case of printing and copying machines which operate with endless paper, the recording substrate is commonly preheated via a preheating saddle, over which the recording substrate glides with its non-toner-laden side and thus picks up heat. In this case, the problem arises that the heat is picked up on the side facing away from the toner, so that heating of the boundary surface with the toner thus takes place only after heating of the actual recording substrate. As a function of the thickness of the recording substrate material and of its structure and of the printing speed, this requires a rapid supply of heating power via the preheating saddle. The processes in thermofixing are extensively described in U.S. Pat. No. 3,938,992, whose publication is a constituent of this application.

For preheating the recording substrate to a temperature in the melting range of the toner material a heating power which is essentially dependent on the temperature difference between entry and exit temperature and the thermal capacity of the recording substrate must be supplied to the recording substrate in the preheating zone.

Now, it has appeared that in the supply, of the heating power, which is too rapid and non-uniform, lasting deformations occur due to a temperature shock occurring in the recording substrate, said deformations being in the form of waves or bulges which influence the fixing process as a whole and in particular the post-processing of the printed recording substrate in a negative way. For this reason, it is favorable to heat the recording substrate as slowly as possible and as uniformly as possible in the preheating zone. The coefficient of temperature rise was established as an essential criterion for the speed with which the recording substrate can be heated without lasting deformations. The coefficient of temperature rise, measured in degrees Kelvin per second, denotes a limiting value for a permissible temperature rise per second during heating of the recording substrate. It is a material-dependent value, which can be determined by experiments. In this case, material samples are thermally loaded dynamically as a function of time and examined for any lasting deformations and warping. In the case of paper as recording substrate material, it was established that the coefficient of temperature rise is dependent on the basis weight (grammage, weight per unit area). The heavier the paper is, the smaller is the coefficient. This means that heavy papers must be heated up more slowly than thin light papers in order to avoid warping. However, if different paper grades are processed in a printing or copying machine, the geometry and the type of the preheating of the thermofixing device must be designed in accordance with this heaviest paper grade. The coefficient of temperature rise of the paper is 120 K/sec. at 160 $g/m^2$ basis weight; 155 K/sec. at 70 $g/m^2$ basis weight.

The temperature coefficient is thus an essential parameter in the dimensioning of the length of the preheating zone or of the preheating saddle used for the heating. If the necessary heating power to be supplied has been determined as a function of the melting temperature which is to occur and of the heaviest recording substrate material to be used and of other parameters, such as printing speed, the necessary heating zone length or gliding surface length on the preheating saddle can be determined whilst keeping the other boundary conditions, such as constant specific power distribution (watts per cm) or uniform thermal energy flow (watts per area) along the saddle, at a minimum temperature difference between saddle surface and recording substrate. For this purpose, by way of example, proceeding from a calculated saddle length in a physical experimental construction, by means of infrared measuring devices operating without contact, the surface temperature of the recording substrate at the entry onto the saddle surface and on leaving the saddle surface is measured in the case of the heaviest recording substrate with the highest permissible printing speed and the temperature rise per second is determined therefrom. By means of comparing with the previously determined coefficient of temperature rise of the recording substrate material, an optimization is possible, the constructional length having to be dimensioned at least in such a way that the temperature rise lies below the coefficient of temperature rise. However, it should be pointed out that the coefficient of temperature rise is a statistical limiting value which, if exceeded, leads to the occurrence of a lasting quantitative material structure change, which makes itself noticeable in a disturbing manner.

Thus, if the minimum saddle length and the saddle construction have been optimized for the worst case, the saddle length can be kept for other lighter papers. However, it is occasionally necessary, in accordance with the reduced heating power necessary for recording the thinner recording substrate, to match said heating power correspondingly. In order that this process is carried out automatically, an entry keyboard for the entry of operating parameters, such as basis weight of the paper, printing speed, etc., can be provided on the machine. A computer-controlled device arranged in the machine, for example within the framework of the machine control system, then automatically determines the necessary heating power and sets it on the heating elements of the heating zone.

In the case of a preheating saddle as is shown in FIG. 1, which is composed of a preheating saddle and a heating saddle, the following relationship resulted for the calculation of the total heating saddle power.

$$P_{max}=P_{Pap}+P_{H2O}+P_{H2Osteam}+P_{convect}$$

$$P_{max}=G_{Pap.max}\times v_{Pap}\times b_{Pap.max}\times c_{Pap}\times T_{Pap}+(G_{H2Omax}/A^*)\times v_{Pap}\times b_{Pap.max}\times c_{H2O}\times T_{H2O}\times+(q_{H2O}\times G_{H2Osteam})/t_{2000\ sheets}+P_{convect.}$$

$$P_{max}=5895\ \text{W}+1343\ \text{W}+1608\ \text{W}+300\ \text{W}$$

$$P_{max}=9146\ \text{W}$$

Description of the parameters and their values:

| These values are true for the most unfavorable conditions (heaviest paper, widest paper, maximum proportion of water) | | |
|---|---|---|
| Temperature of the per preheating | $T_{pap.}$ | = 100° C. − 25° C. = 75 K |
| Speed of the paper web | $V_{pap.}$ | = 0.86 m/s |
| Maximum specific paper weight | $G_{pap.max}$ | = 0.16 kg/m$^2$ |
| Maximum paper width | $b_{Pap.max}$ | = 0.457 m |
| Specific heat of paper | $c_{Pap.}$ | = 1250 J/(kgxK) |
| Maximum $H_2O$ proportion per 2000 sheets | $G_{H2Omax}$ | = 3.2 kg |
| Heating temperature of the $H_2O$ | $T_{H2O}$ | = 70 K |
| Evaporated $H_2O$ proportion per 2000 sheets | $G_{H2Osteam}$ | = 0.5 kg |
| Heat of evaporation of $H_2O$ | $q_{H2O}$ | = 2281 × 10$^3$ J/kg |
| Specific heat of $H_2O$ | $c_{H2O}$ | = 4180 J/(kgxK) |
| Running time for 2000 12-inch sheets | $t_{2000\ sheets}$ | = (609.6 m)/(0.86 m/s) = 709s |
| Area of a 2000 × 12-inch-sheet long paper web | A* | = 274 m$^2$ |

The power is distributed uniformly over the length of heating and preheating saddle. That means that, at a length of the heating saddle of 300 mm and a length of the preheating saddle of 240 mm, there results a specific power distribution in the paper running direction of 169 W/cm.

As previously pointed out with respect to FIG. 1, the heating of the saddles 21 and 23 is carried out by means of electrical resistance elements in the form of heating cartridges 28 (See FIGS. 3 and 9) which are arranged so that they can be exchanged. To accommodate the heating cartridges 28, the saddles 21 and 23 have continuous holes 29. These holes enable the exchange of each individual heating cartridge 28 in the event of a defect. Moreover, the saddles 21 and 23 can thus be cost-effectively produced from extruded aluminum profile.

Figure 9:
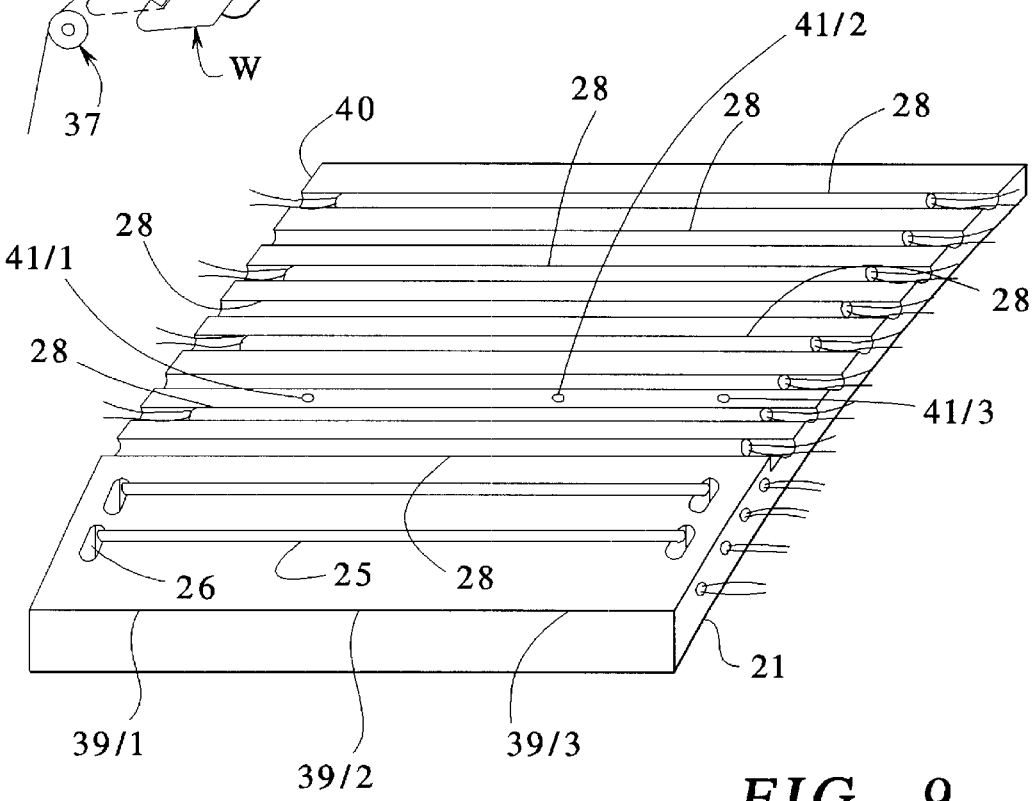
FIG. 9 shows a schematic representation of a heated saddle, used in the thermofixing device, with heating cartridges arranged therein.

By means of the arrangement of the cartridges in the saddles, each saddle 21 and 23, respectively, is subdivided into three heating zones 39/1, 39/2 and 39/3, transversely to the paper running direction (FIG. 9). Here transverse heating zones 39/1 to 39/3 are used for matching the saddles to various recording substrate widths. The first heating zone 39/1 is limited on one side by the fixed paper running edge 40/1. This heating zone 39/1 is as wide as the minimum recording substrate width. The remaining region of the saddles, up to the maximum recording substrate width, is subdivided into the equally wide heating zones 39/2 and 39/3. Each of the transverse heating zones 39/1 to 39/3 has a temperature sensor 41/1 to 41/3 for controlling the heating zones. Said temperature sensor is located in each case transversely to the paper running direction approximately in the center of the respective heating zones. Seen in the paper running direction, the sensor positions are selected such that control is possible to the same temperature both in the standby condition of the printing device (standby) and in the printing operation itself. In this way, the temperature control is simplified. The control temperature and the position of the sensors 41/1 to 41/3 are selected in such a way that the paper temperature at the end of the saddle during the start phase is just as high as during a longer printing phase. In this arrangement, the region from the center as far as the last third of the saddles has proved to be a favorable sensor position.

The heating zones 39/1 to 39/3 are produced by means of the arrangement of the heating cartridges 28 in the holes 29. This is as follows:

One cartridge in each case for the two outer heating zones 39/1 and 39/3 is pushed from both sides into the first hole, of a saddle, in the paper running direction. A heating cartridge 28 for the central zone 39/2 is pushed into the second hole. The third hole is equipped in the same way as the first, and so on. In this way, six heating cartridges 28 are located in each heating zone 39/1 to 39/3.

Figure 11:
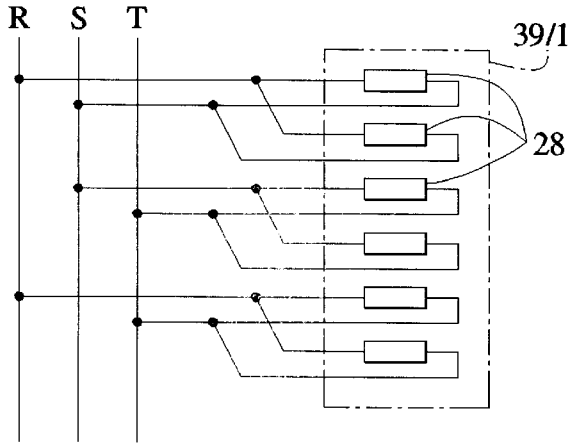
FIG. 11 shows a schematic representation of the wiring of the heating elements in the saddle in the case of operating the printing device on a three-phase power supply in accordance with the US standard.
Figure 12:
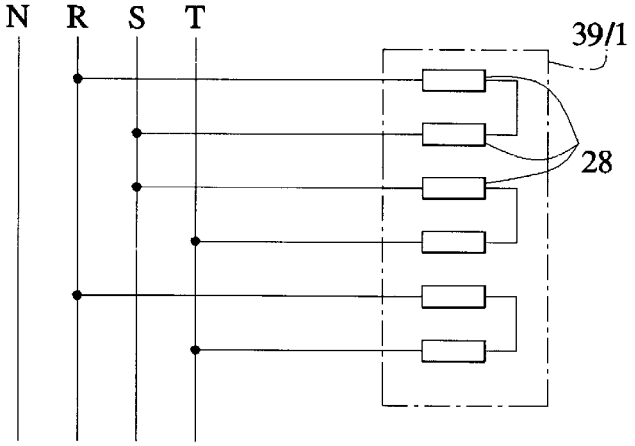
FIG. 12 shows a schematic representation of the wiring of the heating elements in the case of operating the printing device on a three-phase power supply in accordance with the European standard.

As shown in FIGS. 4 and 5, the heating cartridges 28 of the heating zones 39/1 to 39/3 are operated on phases R, S, T and N of a three-phase power supply. As a function of the type of the three-phase power supply (USA, Europe), the heating cartridges are connected in pairs in series (FIG. 12) (European three-phase power supply) or in parallel (FIG. 11) (three-phase power supply USA).

There are thus three pairs of heating cartridges located in each heating zone 39/1 to 39/3. In order to achieve a uniform loading of all three phases, the connection is carried out of a first heating cartridge pair to the phases R, S; of a second heating cartridge pair to the phases S, T; and the connection of a third heating cartridge pair to the phases R, T. However, the possible wiring, of the individual heating cartridges 28, specified in FIGS. 11 and 12 can be varied as desired as a function of the operating power supply used.

Figure 10:
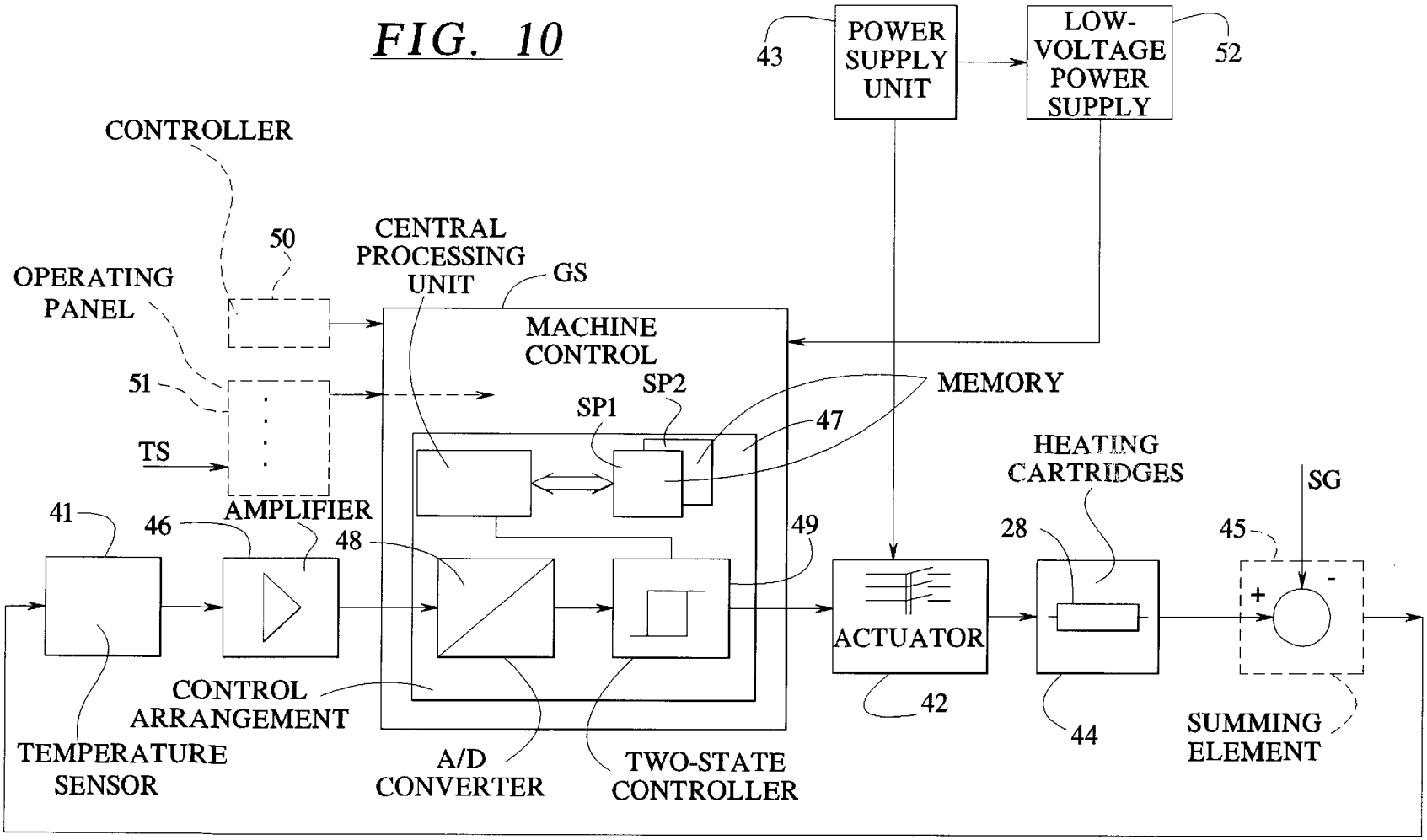
FIG. 10 shows a block circuit diagram of a control arrangement for controlling a heating zone of the saddle.

The surface temperature of the saddles and thus the temperature of the recording substrate is controlled with the aid of a control arrangement, as is shown in FIG. 10.

The control arrangement contains an actuator 42, for example in the form of individual relays for coupling the heating cartridges 28 to a power supply unit 43. Connected downstream of the actuator is the control path 44 with the heating cartridges 28. The actual temperature is registered via the temperature sensors 41/1 to 41/3 and converted by the sensors into an electrical drive signal and amplified in a subsequent amplifier 46. A control arrangement 47 compares the actual temperature with a predeterminable desired temperature TS and controls to the desired temperature TS as a function of the control deviation.

The microprocessor-controlled control arrangement 47 contains an analog-digital converter 48 with associated program-controlled two-state controller 49. Furthermore, it has a central unit CPU, which is connected to corresponding areas of memory SP1 and SP2. In addition, the microprocessor-controlled control arrangement 47 is coupled to the controller 50 of the printing device, which is commonly constructed with an operating panel 51 on the machine. The entire control arrangement can be a component of the machine control system of the machine. An additional low-voltage power supply unit 52, which is coupled to the actual power supply unit 43, ensures the power supply of the machine control system and thus of the microprocessor-controlled control arrangement 47.

As already explained at the beginning, in the use of recording substrates of different material structure, in particular different basis weight, the heating power which is fed to the preheating saddle must be correspondingly matched. This is similarly true for the matching of the saddle exit temperature to the recording substrate to be printed. In order to be able to adjust this heating power or other parameters on the preheating saddle, such as for example the exit temperature, the machine contains an operating panel 51 for the entry of various operating parameters, such as basis weight of the recording substrate, desired exit temperature at the preheating saddle, etc. The operating panel is connected to a computer-controlled arrangement which can be a part of the control arrangement 47 and which contains a central unit CPU, which is connected to corresponding memories SP1 and SP2.

Stored in the memories SP1 to SP2 there are allocation tables or characteristics, via which, in accordance with entry of the corresponding parameters via the operating panel 51, the corresponding electrical values to be controlled and to be regulated of the preheating saddle are allocated. These values are then fed to the control arrangement 47 as desired value. In the exemplary embodiment shown, the desired temperature TS is entered via the operating panel 51, the temperature at which the paper leaves the saddle arrangement (preheating saddle 15) or the entry temperature of the paper into the fixing zone between the rollers 11 and 12 being designated as desired temperature. The statement of the operating parameters was only by way of example. In the case of a change of the printing speed or in the case of a change of the paper width, a matching of the heating power is likewise necessary. This takes place automatically by means of corresponding switching-in of the transverse heating zones 39/1, 39/2 and 39/3 designed to be individually drivable and arranged on the saddle 15 transversely to the recording substrate running direction, or by registering of the set printing speed, the variation of which indeed has an effect as a whole on many units of the machine. In the normal case, in electrophotographic printing devices which operate with endless paper, operations are carried out at a constant recording substrate advance speed (printing speed).

Figure 13:
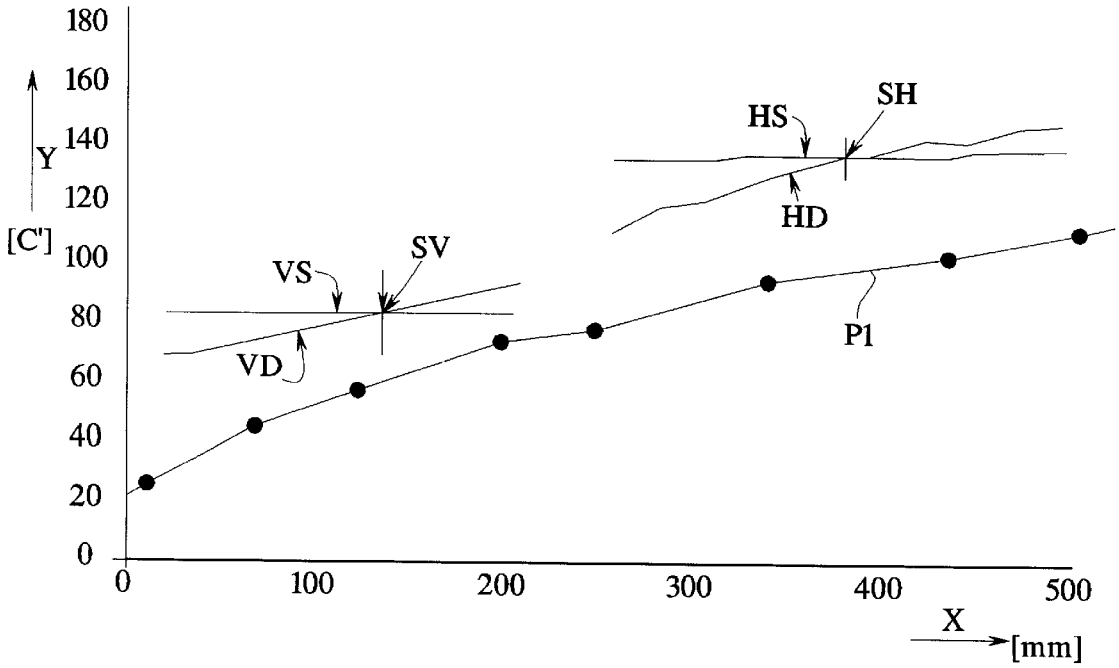
FIG. 13 shows a representation of the temperature curve along the saddle in the paper running direction.

The functioning of the control device is explained using the diagram of FIG. 13. The abscissa X of the diagram in this case designates the position in millimeters, proceeding from paper entry on the saddle surface, the ordinate Y designates the temperature in degrees Celsius. In this case, the temperature variation on the paper or recording substrate is represented in the curve P1. The curves VD and VS here designate the temperature variation on the saddle surface of the preheating saddle 21 in printing operation VD and in standby operation VS. The curves HD and HS the temperature variation in printing operation HD and standby operation HS on the heating saddle surface. The positions of the sensors of the preheating saddle and of the heating saddle are designated by SV and SH in the curves. In this context it should be noted that the diagram represents the temperature variation within the heating zone 39/1 both of the preheating saddle and of the heating saddle, specifically when only this heating zone 39/1 is active, that is to say a recording substrate of minimum width sweeps over the saddle. If recording substrates of other widths are used, a similar temperature variation is true in the case of additional activation of the heating zones 39/2 and 39/3.

The saddle temperature of the preheating saddle 15 is controlled by means of the control arrangement, specifically by means of controlling the heating zones, namely the heating saddle 23 and the preheating saddle 21. In so doing, the aim of the control is a constant desired saddle temperature, the exit temperature of the paper after leaving the saddle being able to be entered as saddle temperature, via the operating panel 51. The microprocessor-controlled control arrangement 47 then converts this desired saddle temperature into corresponding desired temperatures on the preheating saddle 21 and on the heating saddle 23 and controls these together. The level of the desired temperature to be set depends on the type and the material construction of the recording substrate used and on the printing speed, that is to say the paper advance of the machine. In the case of normal paper and a printing speed corresponding to a paper advance speed of approximately 0.89 m/sec, the paper at the saddle inlet has a temperature of 20° and is intended to be heated to a paper exit temperature of approximately 100°. The heating cartridges 28 are now arranged along the heating zones 21 and 23 of the saddle 15 in such a manner and are controlled in such a manner that the thermal energy flow per surface from the saddle to the paper is constant along the saddle. Furthermore, the length of the saddle is fundamentally determined such that the temperature difference $\Delta T$ between saddle surface (gliding surface) and paper becomes constant and as small as possible. The length of the saddle is limited, however, by the maximum constructional length available and can vary from machine to machine. However, as large a length as possible is the aim, so that most careful heating-up of the paper is achieved.

In this case, one problem is the dynamic behavior of the temperature variation at the transition from the standby or start phase to printing operation. In the start phase, that is to say without paper or with paper deposited in the standby condition, thermal dissipation from the saddle takes place simply by means of convection. Nevertheless, it must be ensured that the paper is not excessively heated in the start or standby phase. This is ensured by means of the saddle construction described and by means of the control.

In this arrangement, both in standby operation and in printing operation, the temperature of the saddle is kept constant, the preheating saddle having a temperature of approximately 80° and the heating saddle a temperature of approximately 130°. The result is thus the temperature variation which can be seen in FIG. 13. In standby operation, the preheating saddle has the temperature of 80° over its entire surface, corresponding to the curve VS, and the heating saddle has the temperature of 130° over its entire surface, corresponding to the curve HS. After initiation of printing operation, the temperature variation tilts around the sensor positions SV and SH, so that the steady-state temperature variation represented by the curves VD and HD is set in printing operation. In this steady-state condition, the temperature difference $\Delta T$ between saddle surface and paper is approximately constant along the saddle surface.

A still more exact setting of the constant temperature difference is possible, if the number of controlled heating zones is increased. However, this leads to an additional expenditure. As shown, the condition can also be approximately achieved using one saddle which has two heating zones, namely preheating saddle and heating saddle. In detail, the control sequence is as follows:

After laying t he paper in the printing device and threading through the fixing station, the desired temperature TS is entered via the operating panel 51, corresponding to the paper used. The microprocessor-controlled control arrangement 47 connects the heating cartridges 28 to the phases of the three-phase power supply of the power supply unit 43 via the actuator 42. After the desired temperature is reached, the operational readiness of the fixing station is communicated to the controller 50 of the machine. After printing operation is initiated, heat is withdrawn from the saddle via the paper as a function of the paper temperature, the paper basis weight, the printing speed, the paper thickness, the surface finish of the paper and the width of the paper. This disturbance variable influence is symbolically represented in the control loop of FIG. 10 as disturbance variable SG. The actual temperature resulting after subtracting the disturbance variable is registered via the temperature sensors 41/1 to 41/3 and fed in the form of electrical signals to the microprocessor-controlled control arrangement 47. The latter activates the actuator 42 in a corresponding manner until the prescribed desired temperature is reached and the temperature profile which can be seen in FIG. 13 occurs.

Figure 14:
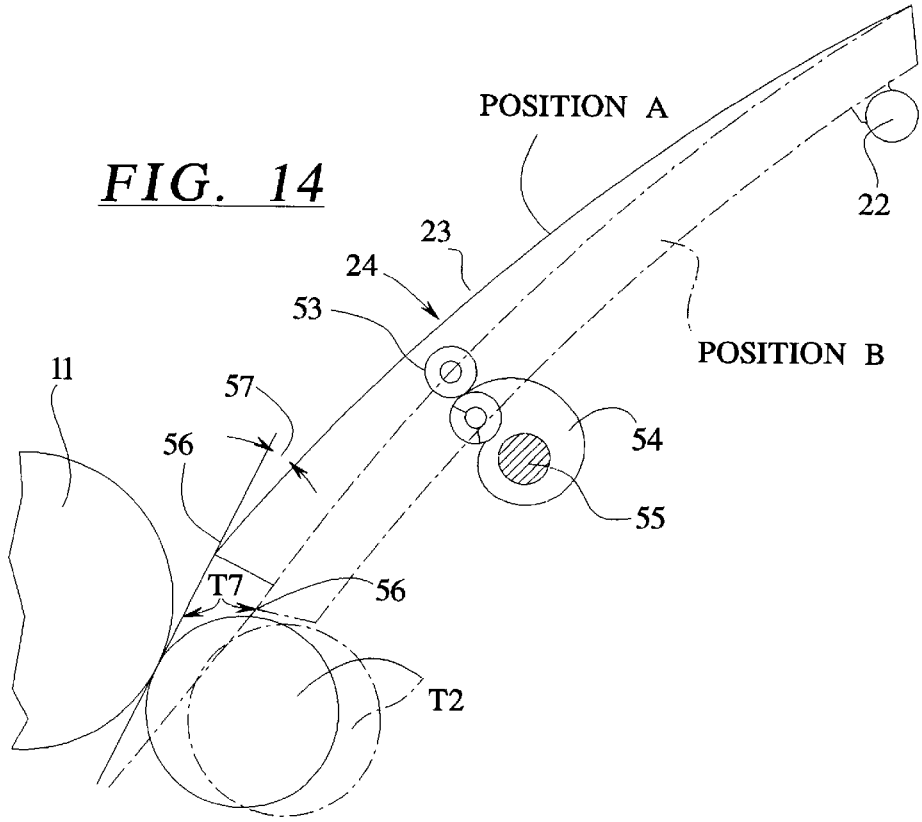
FIG. 14 shows a schematic representation of a heating saddle having a smoothing edge.

As described at the beginning in conjunction with FIG. 1, the heating saddle 23 of the preheating saddle 15 is arranged in the machine so as to be pivotable. For this purpose—as can be seen in FIG. 14—the heating saddle is supported at its input and in a pivotable and detachable manner via a bearing 22 in the machine frame. The heating saddle has, approximately at its center, a cam roller 53 which is rotatably supported on the heating saddle and cooperates with an eccentric snail cam 54 supported movably in the machine frame. The eccentric snail cam 54 is driven via a cam shaft 55, which is connected to a stepping motor, not shown here. By means of rotating the eccentric snail cam 54, the heating saddle 23 rotates about the point of rotation 22. Hence, it can be positioned in different positions as a function of the operational conditions of the machine, namely into an operating position (position A; shown in FIG. 14 with continuous lines) assigned to the fixing operation, with nip roller 12 pivoted in, and into a standby position (position B; shown in FIG. 14 with interrupted lines) assigned to the standby operation, with nip roller 12 pivoted out. In the standby position, the recording substrate 17 is pivoted away from the hot fixing roller 11. Furthermore, however, it is in contact with the heated preheating saddle 15.

In the preheating of the recording substrate 17, be it now of paper or paper-like material or, for example, of plastic, there exists the problem that, as a result of the gassing out of the recording substrate material or as a result of other effects such as loss of water, etc., the recording substrate will shrink, which leads to some reduction in width. Hence, in the transition into the unheated paper running region, small waves or warping occur.

This effect is to be observed in particular in standby operation, in which, in the case of a continuously heated heating saddle, the immobile recording substrate is exposed for a very long time to the heat from the heating saddle. If then, in the event of a renewed initiation of printing operation, the saddle is brought into the operating position by pivoting in and the preheated recording substrate is fed in the fixing gap between fixing roller and nip roller, the warping produced during the passage thought the fixing gap is ironed into the recording substrate by means of pressure and heat, which disturbs the printed image appreciably.

In order to prevent this, the heating saddle 23 has, at its end assigned to the fixing gap, a smoothing edge 56, which is designed as a relatively sharp-edged rounding of the gliding surface 24. If, on leaving the heating saddle 23, the recording substrate web wraps around this heating saddle edge (smoothing edge 56) arranged on the preheating saddle exit region, by as large an angle 57 as possible, this warping of the recording substrate is smoothed out over the wrapped-around saddle edge 56 before the entry into the fixing gap.

The heating saddle edge or smoothing edge 56 should in this case be positioned as close as possible to the fixing gap. A deflection angle of at least 7 degrees of angle or larger has proved to be advantageous, the smoothing effect also occurring to a limited extent already at 5° or 6° deflection angle. Designated by deflection angle 57 is the angle by which the running direction of the recording substrate 17 changes on leaving the gliding surface 24 of the heating saddle 23. In the exemplary embodiment of FIG. 14, with a domed gliding surface 24 of the heating saddle 23, this is the angle between the gliding surface direction (tangential) in the region of the smoothing edge 56 and the feed direction of the recording substrate to the fixing gap between smoothing edge 56 and fixing gap.

So that the smoothing edge 56 does not press into the recording substrate 17 in the standby position (standby operation), the heating saddle 23 is pivoted out in standby operation to such an extent that the recording substrate 17 does not rest on the smoothing edge 48 or does not wrap around the latter.

In the exemplary embodiment, shown in FIG. 1, of the thermofixing device, the preheating saddle 15 consists of a fixed preheating saddle 21 and a heating saddle 23 which is arranged so as to be pivotable. Such a subdivision is also sensible because only a low saddle mass thus has to be pivoted over the heating saddle 23. In addition, the subdivision opens up the possibility of composing the preheating saddle 15 of heating zone modules, for example of a fixed heating zone module "preheating saddle" and a pivotable module "heating saddle" or else, by way of example, of a module forming the heating saddle and a plurality of modules forming the preheating saddle, which then form the preheating saddle 15 in combination. In this way, preheating saddles for various machine variants having, for example, a different printing speed can be constructed in a simple manner. If, for example, the printing speed and thus the recording substrate running speed of a machine variant are reduced, the preheating saddle length needed also reduces. If necessary, the "preheating saddle" module can thus be dispensed with completely and only a pivotable heating saddle module is necessary as preheating saddle. On the other hand, in the case of an increase of the printing speed, the preheating saddle length can be extended by the addition of further heating zone modules.

A crosslinked toner has emerged as a toner material which is particularly suitable for fixing on paper via the described thermofixing device. By means of the careful heating up in the fixing, the advantageous fixing properties, already present per se, of the crosslinked toner can be further improved. For example, there can be used as crosslinked toner a toner which has at least 25 percent by weight of toner particles made of a polymer comprising a polyester or a polymer having styrene groups or a polymer comprising styrene groups, which is crosslinked covalently or ionically to such an extent that the melting range of the toner particles is increased by at least 10% in comparison with corresponding toner particles having a non-cross-linked polymer.

Although various minor changes and modifications might be proposed by those skilled in the art, it will be understood that I wish to include within the claims of the patent warranted hereon all such changes and modifications which reasonably come within my contribution to the art.

I claim as my invention:

1. An electrographic printer thermal fixing system, comprising:

a heat transfer fixing station for fixing a first toner image on a first side of a recording medium by direct heating thermal contact between the recording medium and at least one heating roller;

a heat transfer fixing station for fixing a second toner image on a second side of the recording medium facing opposite the first side by direct heating thermal contact between the recording medium and at least one heating roller;

a pre-heating saddle along a running direction of the recording medium for preheating the recording medium preceding the heat transfer fixing station which fixes the second image;

said preheating saddle comprising a sliding surface for heating and supporting the recording medium over the entire first side at the contact region with the heating saddle;

at least one temperature sensor for providing signals which are dependent on a temperature of said heating saddle at a region of said sliding surface;

a plurality of heating elements arranged in said heating saddle below said sliding surface; and a heating control for controlling the temperature of said heating saddle according to a desired temperature, the heating control receiving signals from said temperature sensor and controlling heating of said heating elements.

2. A system according to claim 1 wherein said heating control receives control signals depending on at least one selected operating parameter.

3. A system according to claim 1 wherein the recording medium comprises a paper web for continuous form printing.

4. A system according to claim 1 wherein said sliding surface of the heating saddle has a toner-repellant plastic layer covering all of said contact region with the first side of the recording medium.

5. A system according to claim 1 wherein the recording medium comprises paper having a coefficient of temperature rise of a maximum of 180° Kelvin per second.

6. A system according to claim 1 wherein a plurality of said temperature sensors are provided, and one of them is positioned in a region approximately centrally of the preheating saddle in the running direction of the recording medium.

7. A system according to claim 1 wherein holes are provided in the preheating saddle for removable mounting of the heating elements.

8. A system according to claim 1 wherein the preheating saddle has a convex sliding surface, the sliding surface having a radius such that, during a fixing operation, the recording medium rests on the sliding surface over an entire length of the preheating saddle.

9. A system according to claim 1 wherein the heating control has a memory for storing empirically determined relationships in the form of allocation tables.

10. A system according to claim 1 wherein a toner used in the system includes thermal fixable toner particles of a polymeric compound, at least 25% by weight of the toner particles comprising an ionically cross-linked polymer selected from a group consisting of polyester and styrene.

11. A system according to claim 1 wherein said at least one temperature sensor provides signals which are dependent on a surface temperature of the heating saddle at a region of the sliding surface, and wherein the heating control controls the surface temperature of the heating saddle according to a desired surface temperature.

12. An electrographic printing method, comprising the steps of:

fixing a first toner image on a first side of a recording medium by direct heating thermal contact between the recording medium and at least one heating roller of a heat transfer fixing station;

fixing a second toner image on a second side of said recording medium opposite said first side by direct heating thermal contact between the recording medium and at least one heating roller of a heat transfer fixing station;

providing a preheating saddle preceding the heat transfer fixing station which fixes the second image, said preheating saddle preceding the heat transfer fixing station for the second image in a running direction of the recording medium;

sliding the recording medium first surface over a sliding surface of the preheating saddle;

providing a temperature sensor for sensing a temperature at a region of said sliding surface of the preheating saddle;

providing a plurality of heating elements arranged in the heating saddle below said sliding surface; and controlling the heating elements so that a desired temperature is maintained at said sliding surface along said preheating saddle to insure proper fixing of said second toner image at the heat transfer fixing station which fixes the second toner image, the sensed temperature by said temperature sensor being used in controlling the heating elements.

13. An electrographic printer thermal fixing system, comprising a heat transfer fixing station for fixing a first toner image on a first side of a recording medium by direct heating thermal contact between a recording medium and at least one heating roller;

a heat transfer fixing station for fixing a second toner image on a second side of the recording medium facing opposite the first side by direct heating thermal contact between the recording medium and at least one heating roller;

a pre-heating saddle along a running direction of the recording medium for pre-heating the recording medium preceding the heat transfer fixing station which fixes the second image;

said pre-heating saddle comprising a sliding surface for heating and supporting the recording medium at the contact region with the heating saddle;

a plurality of heating elements arranged in said heating saddle below said sliding surface; and a heating control for controlling a surface temperature of said heating saddle according to a desired surface temperature for melting the second toner image in a desired way by controlling heating of said heating elements.

14. A system according to claim 13 wherein at least one temperature sensor is provided at least near said sliding surface for providing signals which are representative of the surface temperature of said heating saddle, and providing said signals from said at least one temperature sensor to said heating control for controlling the surface temperature based on said signals from said at least one temperature sensor.

15. An electrographic printing method, comprising the steps of:

fixing a first toner image on a first side of a recording medium by direct heating thermal contact between the recording medium and at least one heating roller of a heat transfer fixing station;

fixing a second toner image on a second side of said recording medium opposite said first side by direct heating thermal contact between the recording medium and at least one heating roller of a heat transfer fixing station;

providing a pre-heating saddle preceding the heat transfer fixing station which fixes the second image, said pre-heating saddle preceding the heat transfer fixing station for the second image in a running direction of the recording medium;

sliding the recording medium first surface over a sliding surface of the pre-heating saddle;

providing a plurality of heating elements arranged in the heating saddle below said sliding surface; and controlling the heating elements so that a desired temperature for melting the second toner image is maintained at said sliding surface along said pre-heating saddle to ensure proper fixing of said second toner image at the heat transfer fixing station which fixes the second toner image.

16. A method according to claim 15 including the step of providing a temperature sensor for sensing a temperature at least near a region of said sliding surface of the pre-heating saddle, and controlling the heating elements based on signals from said temperature sensor.

* * * * *